US007114488B2

(12) United States Patent
Kinose

(10) Patent No.: US 7,114,488 B2
(45) Date of Patent: Oct. 3, 2006

(54) CONTROL APPARATUS FOR INTERNAL COMBUSTION ENGINE

(75) Inventor: Kenichi Kinose, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/268,494

(22) Filed: Nov. 8, 2005

(65) Prior Publication Data

US 2006/0096576 A1 May 11, 2006

(30) Foreign Application Priority Data

Nov. 11, 2004 (JP) ..... 2004-328084

(51) Int. Cl.
*F02B 7/00* (2006.01)
*F02M 51/00* (2006.01)

(52) U.S. Cl. ..... 123/431

(58) Field of Classification Search ..... 123/431, 123/299, 300, 304, 305, 480, 436, 492–494; 701/103–105, 110; 73/118.2
See application file for complete search history.

(56) References Cited

U.S. PATENT DOCUMENTS 5,701,871 A * 12/1997 Munakata et al. ..... 123/491
6,508,234 B1 * 1/2003 Machida et al. ..... 123/478
2001/0039936 A1 11/2001 Ichihara et al.
2002/0170541 A1 11/2002 Kenichi et al.
2004/0007209 A1 1/2004 Ohtani

FOREIGN PATENT DOCUMENTS

| | | |
|---|---|---|
| EP | 1 138 901 A2 | 10/2001 |
| EP | 1 260 695 A2 | 11/2002 |
| JP | A 5-231221 | 9/1993 |
| JP | A 11-303669 | 11/1999 |

* cited by examiner

*Primary Examiner*—Hai Huynh
(74) *Attorney, Agent, or Firm*—Oliff & Berridge, PLC

(57) ABSTRACT

An engine ECU executes a program comprising the steps of: calculating a post-warm-up steady-state port wall deposit quantity (a); calculating a shared-injection steady-state port wall deposit quantity (b) based on port wall deposit quantity (a); calculating a difference (c) in one cycle of shared-injection steady-state port wall deposit quantity (b); making a correction considering an engine temperature and an engine speed to calculate a transition correction quantity (d); and converting transition correction quantity (d) into a wave form representing temporal transition to make a wall deposit correction with higher priority on a port injection quantity.

14 Claims, 8 Drawing Sheets

CONTROL APPARATUS FOR INTERNAL COMBUSTION ENGINE

This nonprovisional application is based on Japanese Patent Application No. 2004-328084 filed with the Japan Patent Office on Nov. 11, 2004, the entire contents of which are hereby incorporated by reference.

BACKGROUND OF THE INVENTION

1. Field of the Invention

The present invention relates to a control apparatus for an internal combustion engine having a first fuel injection mechanism (an in-cylinder injector) for injecting a fuel into a cylinder and a second fuel injection mechanism (an intake manifold injector) for injecting a fuel into an intake manifold or an intake port, and relates particularly to a technique as to a quantity of fuel deposited on an internal wall of an intake port when a fuel injection ratio between the first and second fuel injection mechanisms is changed, or when a load required for the internal combustion engine is changed.

2. Description of the Background Art

An internal combustion engine having an intake manifold injector for injecting a fuel into an intake manifold of the engine and an in-cylinder injector for injecting a fuel into a combustion chamber of the engine, and configured to determine a fuel injection ratio between the intake manifold injector and the in-cylinder injector based on an engine speed and an engine load, is known. In this internal combustion engine, a total injection quantity corresponding to the sum of the fuel injected from both fuel injection valves is predetermined as a function of the engine load, and the total injection quantity is increased as the engine load is greater.

In such an internal combustion engine, when the engine load has exceeded a set load and a fuel injection from the intake manifold injector is initiated, part of the fuel injected from the intake manifold injector deposits on an internal wall of the intake manifold. As a result, fuel supplied from the intake manifold to the chamber of the engine is smaller in quantity than fuel having been injected from the in-cylinder injector. Accordingly, if fuel is injected from each of the fuel injection valves based on the injection quantity predetermined as a function of the engine load, when fuel injection from the intake manifold injector is started, a fuel quantity actually supplied to the engine combustion chamber becomes smaller than a requested fuel quantity (a lean state). Thus, a problem arises that the output torque of the engine temporarily drops.

Additionally, in such an internal combustion engine, when the engine load has dropped lower than a set load and fuel injection from the intake manifold injector is stopped, the fuel deposited on the internal wall of the intake manifold is continued to be supplied to the engine combustion chamber. As a result, if fuel is injected from each of the fuel injection valves based on the injection quantity predetermined as a function of the engine load, when fuel injection from the intake manifold injector is stopped, a fuel quantity actually supplied to the engine combustion chamber becomes greater than a requested fuel quantity (a rich state). Thus, a problem arises that the output torque of the engine temporarily rises.

Japanese Patent Laying-Open No. 05-231221 discloses a fuel injection type internal combustion engine including an in-cylinder injector for injecting a fuel into a cylinder and an intake manifold injector for injecting a fuel into an intake manifold or an intake port, for preventing fluctuations in engine output torque when starting and stopping port injection. The fuel injection type internal combustion engine includes a first fuel injection valve (an intake manifold injector) for injecting fuel into an engine intake manifold and a second fuel injection valve (an in-cylinder injector) for injecting the fuel into an engine combustion chamber, wherein, when an engine operation state is in a predetermined operation range, fuel injection from the first fuel injection valve is stopped, and when an engine operation state is not in the predetermined operation range, the fuel is injected from the first fuel injection valve. The fuel injection type internal combustion engine includes means for estimating a deposited fuel quantity on a manifold internal wall when fuel injection from the first fuel injection valve is started, and for estimating a flow-in quantity of the deposited fuel flowing into the engine combustion chamber when fuel injection from the first fuel injection valve is stopped, and means for correcting a fuel quantity injected from the second fuel injection valve to be increased by the above-mentioned deposited fuel quantity when the fuel injection from the first fuel injection valve is started, and for correcting a fuel quantity injected from the second fuel injection valve to be decreased by the above-mentioned flow-in quantity when the fuel injection from the first fuel injection valve is stopped.

According to the fuel injection type internal combustion engine, by correcting a fuel quantity injected from the second fuel injection valve to be increased by a deposited fuel quantity when fuel injection from the first fuel injection valve is started, a fuel quantity actually supplied to the engine combustion chamber satisfies a required fuel quantity; by correcting the fuel quantity injected from the second fuel injection valve to be decreased by a flow-in quantity when fuel injection from the first fuel injection valve is stopped, a fuel quantity actually supplied to the engine combustion chamber satisfies a required fuel quantity. As a result, in either case of starting and stopping the fuel supply from the first fuel injection valve, a fuel quantity supplied to engine combustion chamber satisfies a required fuel quantity, and therefore the engine output torque is prevented from being fluctuated.

However, in the fuel injection type internal combustion engine disclosed in Japanese Patent Laying-Open No. 05-231221, a fuel quantity injected from the second fuel injection valve (in-cylinder injector) is corrected, only when fuel injection from the first fuel injection valve (intake manifold injector) that has not been performed is started, or when fuel injection from the first fuel injection valve (intake manifold injector) that has been performed is stopped. Specifically, it addresses: the case where DI ratio r (a ratio of a quantity of fuel injected from the in-cylinder injector to a total quantity of the fuel being injected) changes from 1 (from a state where fuel is injected solely from the in-cylinder injector to a state where fuel injection from the intake manifold injector is started); or the case where DI ratio r changes from 0 (from a state where the fuel is injected solely from the intake manifold injector to a state where fuel injection from the in-cylinder injector is started). Here, a wall deposit quantity involved with turning ON/OFF of the intake manifold injector is merely corrected using the in-cylinder injector.

Further, normally, a load required for the internal combustion engine transitionally fluctuates when a vehicle is traveling. When the load transitionally fluctuates, the required total fuel quantity as well as the DI ratio likewise fluctuate. Accordingly, the fuel quantity injected from the intake manifold injector transitionally fluctuates. To such a transitional fluctuation of the load, a correction must be made that is different from when the fuel injection that has not been performed is started or when the fuel injection that has been performed is stopped.

It is considered that such a problem arises due to the following factors. Conventionally, in an engine having only an intake manifold injector, as to a wall deposit quantity in a steady state after warm-up having been set in accordance with a load, an effect on a deposit quantity due to an intake pipe pressure and an injection quantity (proportional to a load) has been expressed. When a required fuel quantity corresponding to the load is shared between the in-cylinder injector and the intake manifold injector, the proportional relationship is not established between a quantity of fuel injected from the intake manifold injector and a load and DI ratio. Accordingly, a wall deposit quantity cannot correctly be known by expressing a wall deposit quantity in a steady state only by a function of a load.

SUMMARY OF THE INVENTION

The present invention has been made to solve the above-described problem, and an object of the present invention is to provide a control apparatus for an internal combustion engine having first and second fuel injection mechanisms bearing shares, respectively, of injecting fuel into a cylinder and an intake manifold, respectively, that can accurately estimate a wall deposit quantity when a load and/or DI ratio varies to make a correction.

The present invention in one aspect provides a control apparatus for an internal combustion engine that controls an internal combustion engine having a first fuel injection mechanism injecting fuel into a cylinder and a second fuel injection mechanism injecting the fuel into an intake manifold. The control apparatus includes: a controller controlling the first and second fuel injection mechanisms to bear shares, respectively, of injecting the fuel based on a condition required for the internal combustion engine; and an estimator estimating wall-deposited fuel of the intake manifold when a fuel injection ratio varies from a state where one of the first and second fuel injection mechanisms does not stop fuel injection. The estimator estimates the wall-deposited fuel of the intake manifold based on at least one of a load of the internal combustion engine and the fuel injection ratio.

According to present invention, when the first fuel injection mechanism (e.g., an in-cylinder injector) and the second fuel injection mechanism (e.g., an intake manifold injector) both inject the fuel (0<DI ratio r<1), if, for example, DI ratio r increases stepwise (r<1) while a load to the internal combustion engine is the same or a load to the internal combustion engine decreases stepwise while DI ratio r is the same, a fuel injection quantity of the intake manifold injector decreases stepwise. Here, the fuel having been deposited on the intake port is taken into the combustion chamber. This would invite a rich air-fuel ratio, and therefore wall-deposited fuel necessary for a correction to decrease the fuel injection quantity is estimated. Conversely, when the in-cylinder injector and the intake manifold injector both inject the fuel (0<DI ratio r<1), if DI ratio r decreases stepwise (r<1) while a load to the internal combustion engine is the same or a load to the internal combustion engine increases stepwise while DI ratio r is the same, a fuel injection quantity of the intake manifold injector increases stepwise. Here, the fuel taken into the combustion chamber decreases until a prescribed quantity of fuel deposits on the intake port. This would invite a lean air-fuel ratio, and therefore wall-deposited fuel necessary for a correction to increase the fuel injection quantity is estimated. Further, when a load to the internal combustion engine varies stepwise and DI ratio r varies stepwise (r<1), a fuel injection quantity of the intake manifold injector varies stepwise. In such a case also, the fuel having been deposited on the intake port is taken into the combustion chamber to make the air-fuel ratio rich when a fuel injection quantity of the intake manifold injector decreases stepwise, and the fuel taken into the combustion chamber decreases until a prescribed quantity of fuel deposits on the intake port to make the air-fuel ratio lean when a fuel injection quantity of the intake manifold injector increases stepwise. Accordingly, wall-deposited fuel necessary for a correction to increase the fuel injection quantity is estimated. Thus, while a state where the in-cylinder injector and the intake manifold injector bear shares, respectively, of injecting the fuel continues (i.e., when it is not stopped with fuel injection of either of the injectors) before and after a variation in DI ratio r and/or in a load to the internal combustion engine, for example deterioration of the emission due to, for example, a delay in following the feedback of the air-fuel ratio can be prevented, and whereby a desired combustion state is maintained. Thus it is possible to provide a control apparatus for an internal combustion engine having first and second fuel injection mechanisms bearing shares, respectively, of injecting fuel into a cylinder and an intake manifold, respectively, that can accurately estimate a wall deposit quantity when a load and/or DI ratio varies to make a correction.

Preferably, the estimator calculates a wall deposit quantity solely by the second fuel injection mechanism in a steady state, in accordance with the load of the internal combustion engine. The estimator modifies the calculated wall-deposit quantity, in accordance with the fuel injection ratio. The estimator estimates the wall-deposited fuel of the intake manifold based on a difference of the modified wall deposit quantity in predetermined time intervals.

According to the present invention, for example, as to wall-deposited fuel of an intake manifold in a steady state when fuel is injected solely from the intake manifold injector, a map determined by a load to the internal combustion engine is prepared in advance. Based on the load, a wall deposit quantity in a steady state and only in the intake manifold injector is modified while considering DI ratio r, to be a wall deposit quantity in a steady state and in shared injection. As to the modified wall deposit quantity, a difference in one cycle of the internal combustion engine is determined to estimate a wall deposit quantity in a transitional period and in shared injection. Thus, a wall deposit quantity in a transitional period can accurately be estimated.

Further preferably, the controller controls the first and second fuel injection mechanisms to bear shares, respectively, of correcting the estimated wall-deposited fuel for a range where the first and second fuel injection mechanisms bear shares, respectively, of a fuel injection quantity.

According to the present invention, if a fuel quantity by a correction considering a wall deposit quantity becomes smaller than a minimum injection quantity of the intake manifold injector, a correction to the wall-deposited fuel by decreasing the fuel injection quantity of the intake manifold injector is no longer possible. In this state the air-fuel ratio is still rich, and therefore a correction to the wall-deposited fuel is conducted using the in-cylinder injector. The fuel injection quantity of the in-cylinder injector is determined by subtracting a fuel injection quantity that cannot be covered by the intake manifold injector. Additionally, if a fuel quantity by a correction considering a wall deposit quantity becomes greater than a maximum injection quantity of the intake manifold injector, a correction to the wall-deposited fuel by increasing the fuel injection quantity of the intake manifold injector is no longer possible. In this state the air-fuel ratio is still lean, and therefore a correction to the wall-deposited fuel is conducted using the in-cylinder injector. The fuel injection quantity of the in-cylinder injector is determined by adding a fuel injection quantity that cannot be covered by the intake manifold injector. Thus, a correction to the wall deposit quantity can accurately be conducted.

Further preferably, the controller controls the first and second fuel injection mechanisms to correct the estimated wall-deposited fuel based on a temporal variation of a correction quantity being set corresponding to a load variation.

According to the present invention, the estimated wall-deposited fuel can be corrected such that a temporal variation of a correction quantity is great when a load variation is abrupt and it is small when the load variation is moderate, so that the wall deposit quantity is corrected conforming to a load variation of the internal combustion engine.

Further preferably, the controller corrects the wall-deposited fuel placing higher priority on the second fuel injection mechanism.

According to the present invention, by conducting a correction placing higher priority on a fuel injection quantity of the intake manifold injector being a factor of the wall-deposited fuel, the factor itself can be eliminated. Additionally, by conducting a correction placing higher priority on the fuel injection quantity of the intake manifold injector when DI ratio r does not vary, DI ratio r can be maintained.

Further preferably, the controller controls the first and second fuel injection mechanisms so that, when a fuel quantity decreased by the correction becomes smaller than a minimum fuel quantity of the second fuel injection mechanism, a fuel injection quantity of the second fuel injection mechanism is set to 0 or to the minimum fuel quantity and a remainder of the correction is covered by a fuel injection quantity of the first fuel injection mechanism.

According to the present invention, when DI ratio r increases stepwise ($r<1$) and/or a load to the internal combustion engine decreases stepwise, a fuel injection quantity of the intake manifold injector decreases stepwise. Here, as the fuel having been deposited on the intake port is taken into the combustion chamber to make the air-fuel ratio rich, a correction to the wall-deposited fuel is conducted with the intake manifold injector. If a fuel quantity in an attempt to make a correction to decrease the fuel injection quantity of the intake manifold injector becomes smaller than a minimum fuel quantity of the intake manifold injector, the correction to the wall-deposited fuel by decreasing the fuel injection quantity of the intake manifold injector is no longer possible. In this state the air-fuel ratio is still rich, and therefore a correction to the wall-deposited fuel is conducted using the in-cylinder injector. The fuel injection quantity of the in-cylinder injector is determined by subtracting a fuel injection quantity that cannot be covered by the intake manifold injector.

Further preferably, the controller controls the first and second fuel injection mechanisms so that, when a fuel quantity increased by the correction becomes greater than a maximum fuel quantity of the second fuel injection mechanism, a fuel injection quantity of the second fuel injection mechanism is set to the maximum fuel quantity and a remainder of the correction is covered by a fuel injection quantity of the first fuel injection mechanism.

According to the present invention, when DI ratio r decreases stepwise ($0<r$) and/or a load to the internal combustion engine increases stepwise, a fuel injection quantity of the intake manifold injector increases stepwise. Here, as the fuel taken into the combustion chamber decreases until a predetermined quantity of fuel deposits on the intake port to make the air-fuel ratio lean, a correction to the wall-deposited fuel is conducted with the intake manifold injector. If a fuel quantity in an attempt to make a correction to increase the fuel injection quantity of the intake manifold injector becomes greater than a maximum fuel quantity of the intake manifold injector, the correction to the wall-deposited fuel by increasing the fuel injection quantity of the intake manifold injector is no longer possible. In this state the air-fuel ratio is still lean, and therefore a correction to the wall-deposited fuel is conducted using the in-cylinder injector. The fuel injection quantity of the in-cylinder injector is determined by adding a fuel injection quantity that cannot be covered by the intake manifold injector.

Further preferably, the first fuel injection mechanism is an in-cylinder injector and the second fuel injection mechanism is an intake manifold injector.

According to the present invention, a control apparatus for an internal combustion engine having separately provided first and second fuel injection mechanisms implemented by an in-cylinder injector and an intake manifold injector to share injecting fuel can be provided that can accurately calculate a wall deposit quantity to make a correction when a load and/or DI ratio varies.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
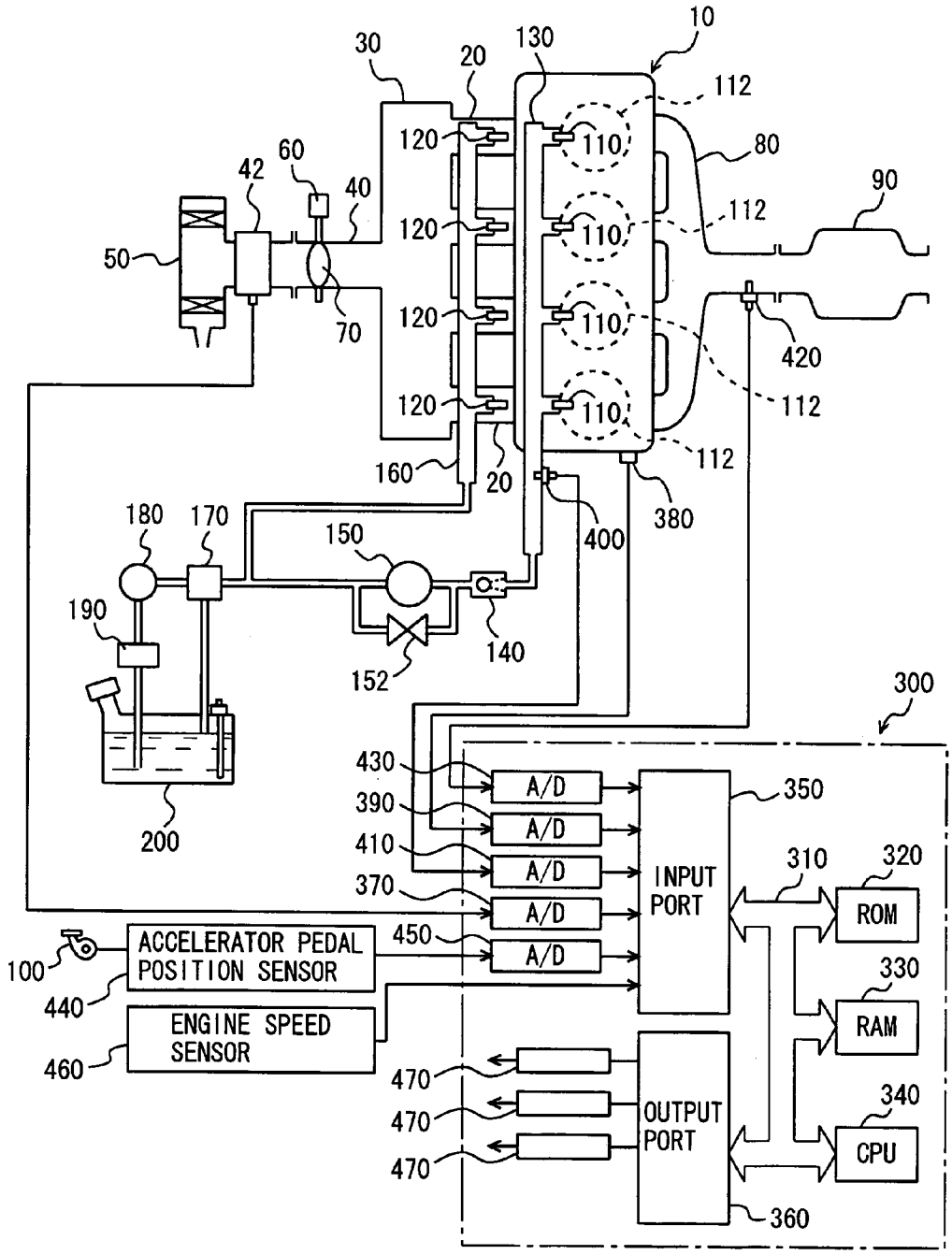
FIG. 1 is a schematic configuration diagram of an engine system controlled by a control apparatus according to an embodiment of the present invention.

Hereinafter, an embodiment of the present invention will be described with reference to the drawings. In the following description, the same parts have the same reference characters allotted and also have the same names and functions. Thus, detailed description thereof will not be repeated.

FIG. 1 is a schematic configuration diagram of an engine system that is controlled by an engine ECU (Electronic Control Unit) implementing the control apparatus for an internal combustion engine according to an embodiment of the present invention. In FIG. 1, an in-line 4-cylinder gasoline engine is shown, although the application of the present invention is not restricted to such an engine.

As shown in FIG. 1, the engine 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. In the present embodiment, an internal combustion engine having two injectors separately provided is explained, although the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

More specifically, in high-pressure fuel pump 150 that pressurizes the fuel with a pump plunger which is moved upward and downward by means of a cum attached to a cum shaft, electromagnetic spill valve 152 is provided on pump intake side and has its timing of closing in a pressurizing process feedback-controlled by engine ECU 300 using a fuel pressure sensor 400 provided at fuel delivery pipe 300. Thus, a pressure of fuel (fuel pressure) inside fuel delivery pipe 130 is controlled. In other words, controlling electromagnetic spill valve 152 by engine ECU 300, the quantity and pressure of the fuel supplied from high-pressure fuel pump 150 to fuel delivery pipe 130 are controlled.

Each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. A coolant temperature sensor 380 is attached to engine 10, and generates an output voltage proportional to a coolant temperature of the engine, which is input via an A/D converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10 is rich or lean with respect to a theoretical air-fuel ratio.

Accelerator pedal 100 is connected with an accelerator pedal position sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator pedal position sensor 440 and engine speed sensor 460, and correction values thereof set based on the engine coolant temperature.

Figure 2:
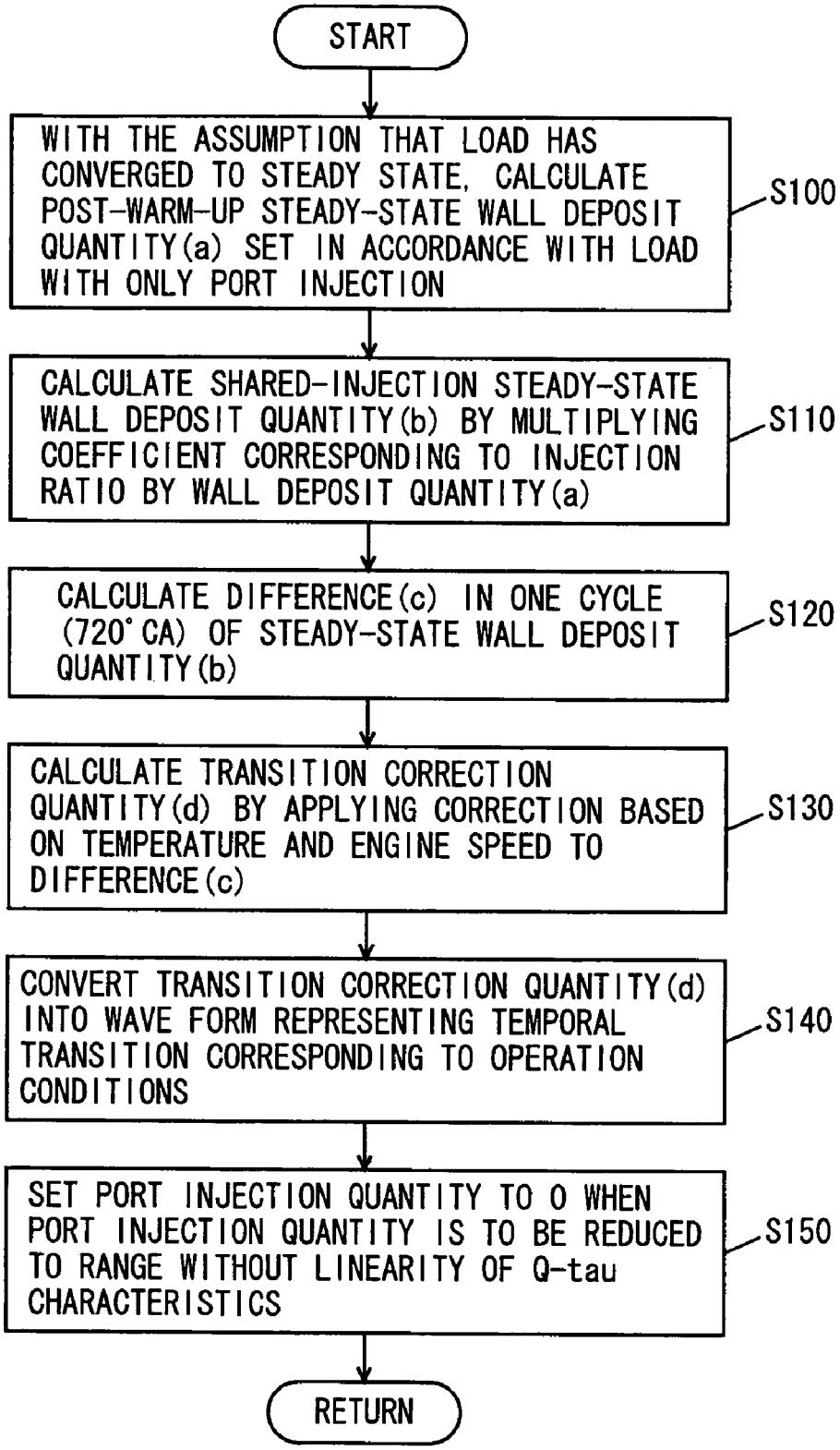
FIG. 2 is a flowchart illustrating a control structure of a program that is executed by the engine ECU implementing the control apparatus according to the embodiment of the present invention.

Referring to FIG. 2, a control structure of a program that is executed by engine ECU 300 implementing the control apparatus according to an embodiment of the present invention will be described. It is noted that the flowchart is executed at predetermined time intervals, or at a predetermined crank angle of engine 10.

Figure 3:
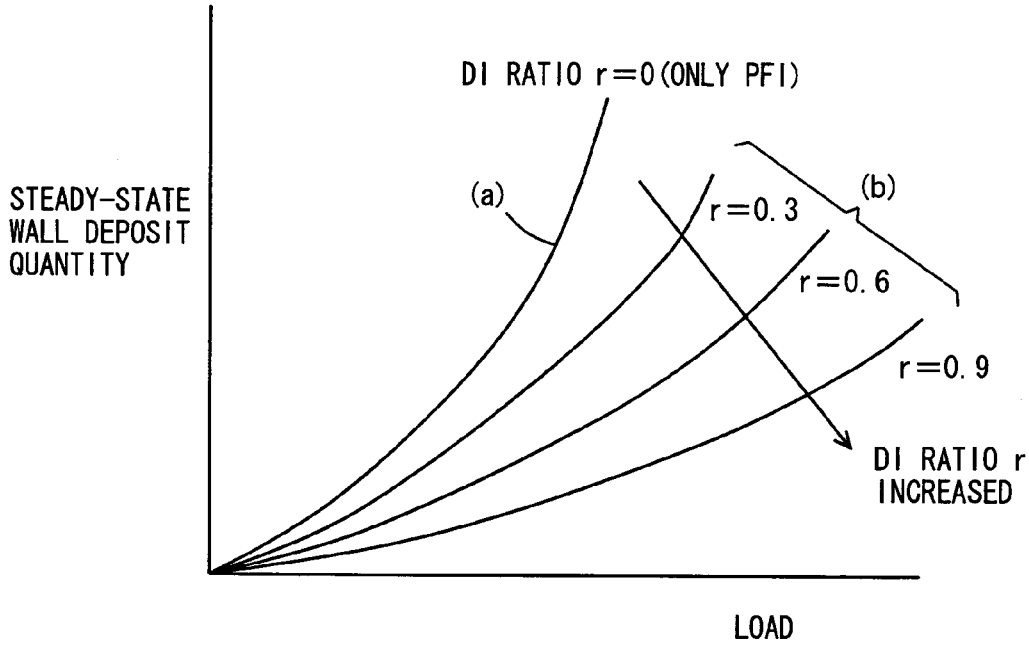
FIGS. 3 and 7–9 each show the relationship between an engine load and a steady state wall deposit quantity (1).

In step (hereinafter step is abbreviated as S) 100, with the assumption that a load to engine 10 has converged to a steady state, engine ECU 300 calculates a wall deposit quantity in a steady state after warm-up (a) (also referred to as post-warm-up steady-state wall deposit quantity (a)), that is set in accordance with a load when injection is solely conducted by intake manifold injector 120 (port injection only). Here, a map as shown in FIG. 3 (the map showing the relationship between a load to engine 10 and a steady-state wall deposit quantity) is prestored in the internal memory of engine ECU 300. Based on the characteristic curve of DI ratio r=0, the post-warm-up steady-state wall deposit quantity (a) is calculated ((a) in FIG. 3). Thus, calculating a steady-state wall deposit quantity using a load and DI ratio r as parameters as shown in FIG. 3, the effect of an intake pipe pressure and an injection quantity, which largely affect a wall deposit quantity, can be expressed.

In S110, engine ECU 300 calculates a wall deposit quantity in a steady state with injection from the both injectors (b) (also referred to as shared-injection steady-state wall deposit quantity (b)), by multiplying a coefficient corresponding to an injection ratio (DI ratio r) by wall deposit quantity (a). Here, multiplying the characteristic curve (a) indicative of a wall deposit quantity in a steady state when intake manifold injector 120 is solely used as shown in FIG. 3 by a coefficient corresponding to DI ratio r, shared-injection steady-state wall deposit quantity (b) shown in (b) of FIG. 3 is calculated. It is noted that, as shown in FIG. 3, a fuel injection quantity of intake manifold injector 120 relatively decreases as DI ratio r increases, and therefore the steady-state wall deposit quantity decreases. It is noted that the characteristic curve shown in FIG. 3 is one example, and the present invention is not restricted to such a characteristic curve.

In S120, engine ECU 300 calculates a difference (c) in a cycle (720° CA) of steady-state wall deposit quantity (b).

In S130, engine ECU 300 calculates a correction quantity at transition (d) (also referred as transition correction quantity (d)), by applying a correction based on a temperature of engine 10 (an engine coolant temperature) and an engine speed to difference (c). Here, for example, the correction is made so that the wall deposit quantity decreases as the temperature is higher since the fuel deposited on the intake port is easily atomized, and so that the wall deposit quantity decreases as the engine speed is faster since the flow velocity of intake is faster.

Figure 4:
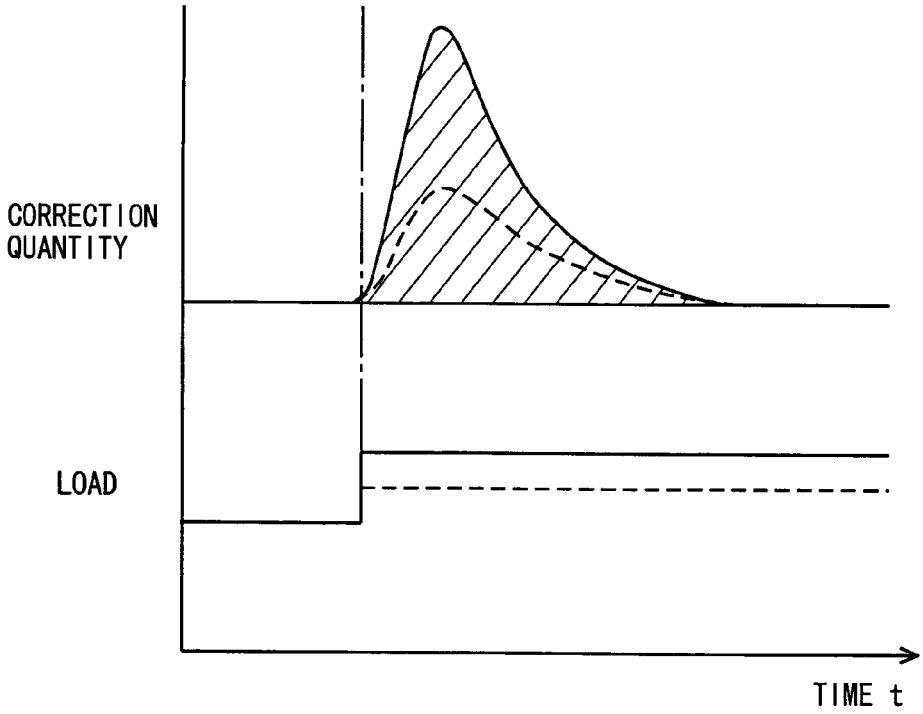
FIGS. 4 and 5 each show a temporal variation of an engine load and a correction quantity.
Figure 5:
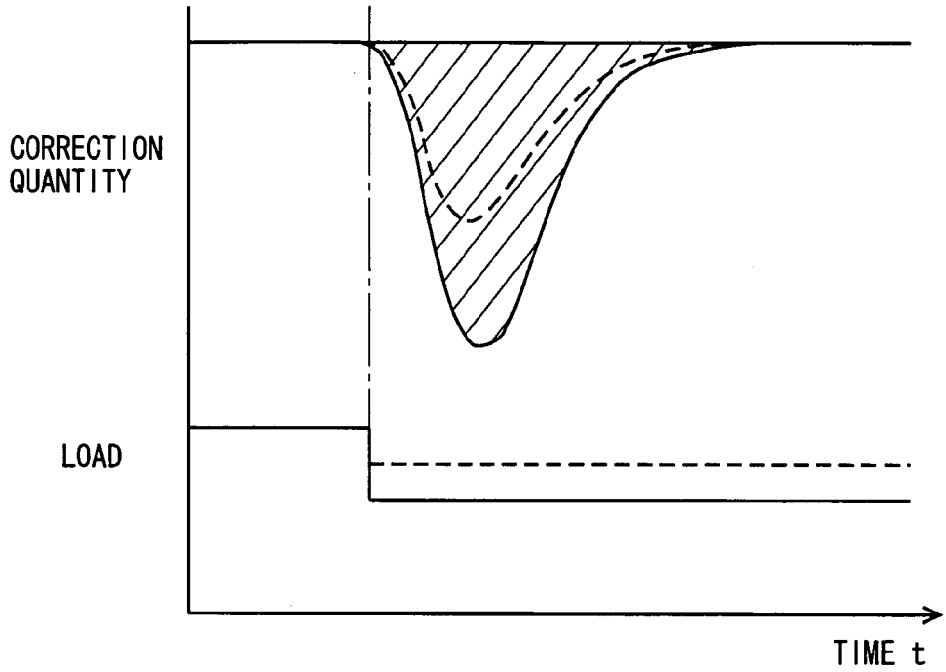

In S140, engine ECU 300 converts transition correction quantity (d) into a wave form representing temporal transition corresponding to operation conditions, and corrects with higher priority the port injection quantity. Here, a correction quantity is converted based on a wave form representing temporal transition as shown in FIGS. 4 and 5. FIG. 4 shows a case where a load to engine 10 increases, whereas FIG. 5 shows a case where a load to engine 10 decreases. In each of FIGS. 4 and 5, the solid lines show abrupt load fluctuation and temporal variation of the wall deposit correction quantity corresponding to the load fluctuation, whereas the broken lines show moderate load fluctuation and temporal variation of the wall deposit correction quantity corresponding to the load fluctuation. The hatched areas in FIGS. 4 and 5 each represent a total wall deposit correction quantity. As shown in FIGS. 4 and 5, the correction quantity varies more abruptly when the load fluctuation is abrupt than when it is moderate. In other words, when the degree of change in the load fluctuation is great, the correction quantity for causing immediate change is also great. Based on such a wave form representing temporal transition, the correction quantity is converted. Further, when the vehicle is accelerating (when the load is increasing), part of the fuel injected from intake manifold injector 120 deposits on the wall of the intake pipe, and when the vehicle is decelerating (when the load is decreasing), part of the fuel having been deposited on the wall of the intake pipe flows into the combustion chamber. Therefore, when the original DI ratio r is constant, in order to maintain that ratio constant, the fuel injection quantity of intake manifold injector 120 is corrected with higher priority.

Figure 6:
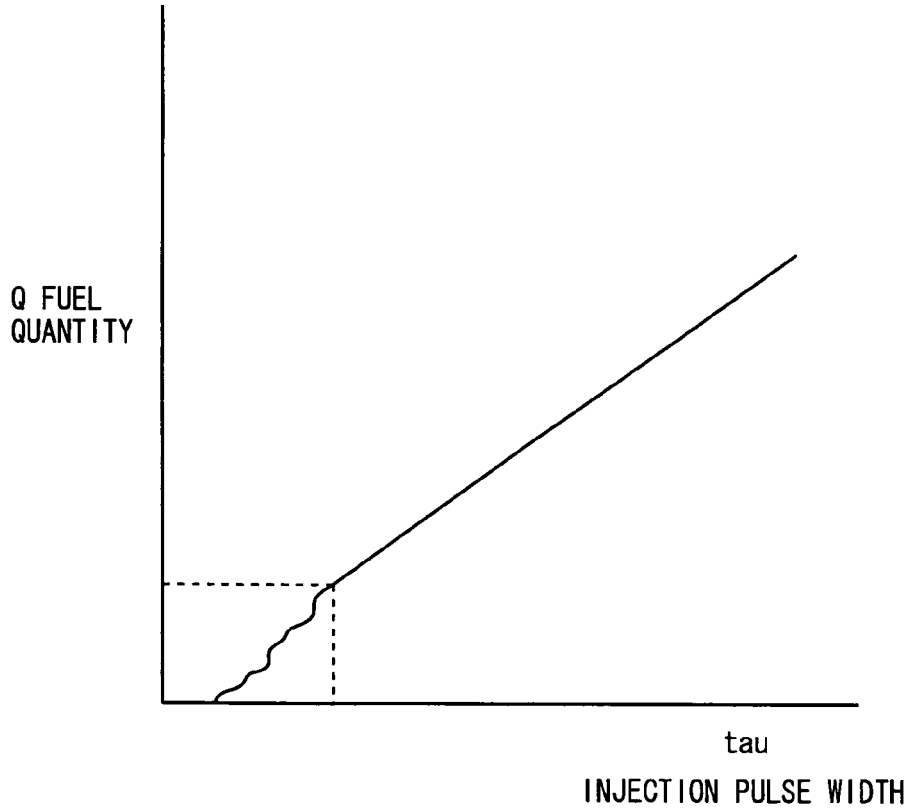
FIG. 6 shows the relationship between an injection pulse width and a fuel quantity.

In S150, engine ECU 300 sets an injection quantity of intake manifold injector 120 (port injection quantity) to 0 when the port injection quantity is to be decreased to a range without a linearity of Q-tau characteristics. It should be noted that the injection quantity of intake manifold injector 120 (port injection quantity) may be set to a minimum injection quantity with the linearity of Q-tau characteristics. Here, using a map shown in FIG. 6 (a map indicative of Q-tau characteristics that is the relationship between an injection pulse width Tau and a fuel quantity Q), whether it is a range with the linearity of Q-tau characteristics or not is determined. Specifically, in a range without the linearity of Q-tau characteristics, the accuracy of the correction quantity cannot be ensured, and therefore, a correction request for decreasing the fuel injection quantity of intake manifold injector 120 cannot be satisfied with high accuracy. Hence, by decreasing a fuel injection quantity of in-cylinder injector 110, a correction of a fuel injection quantity based on a wall deposit quantity is made.

Figure 7:
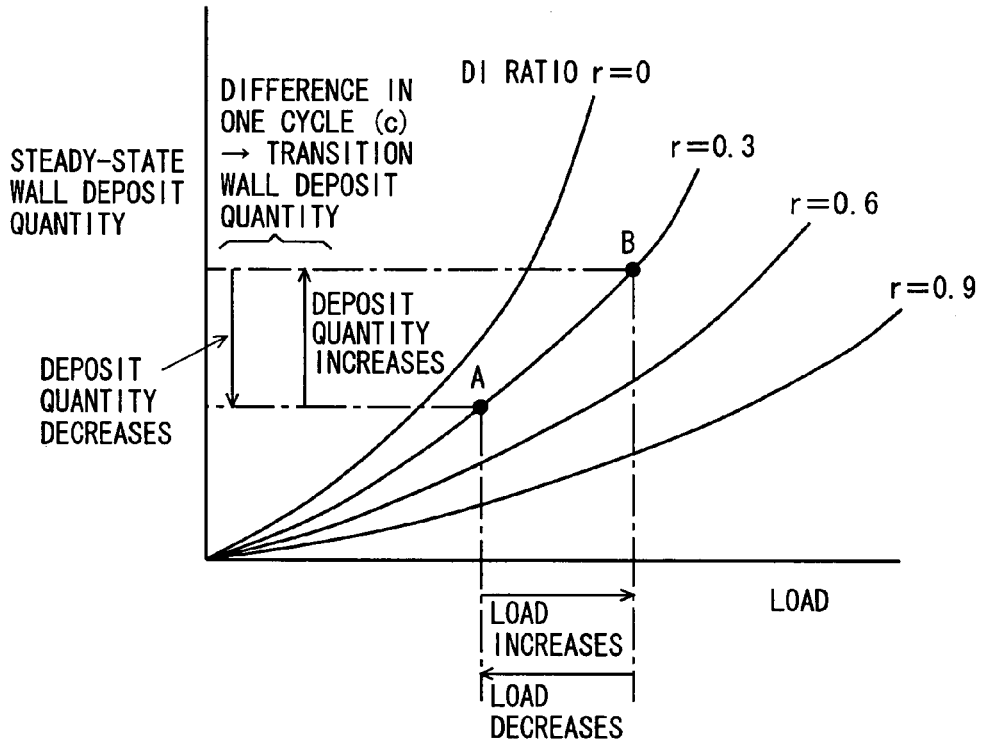
Figure 8:
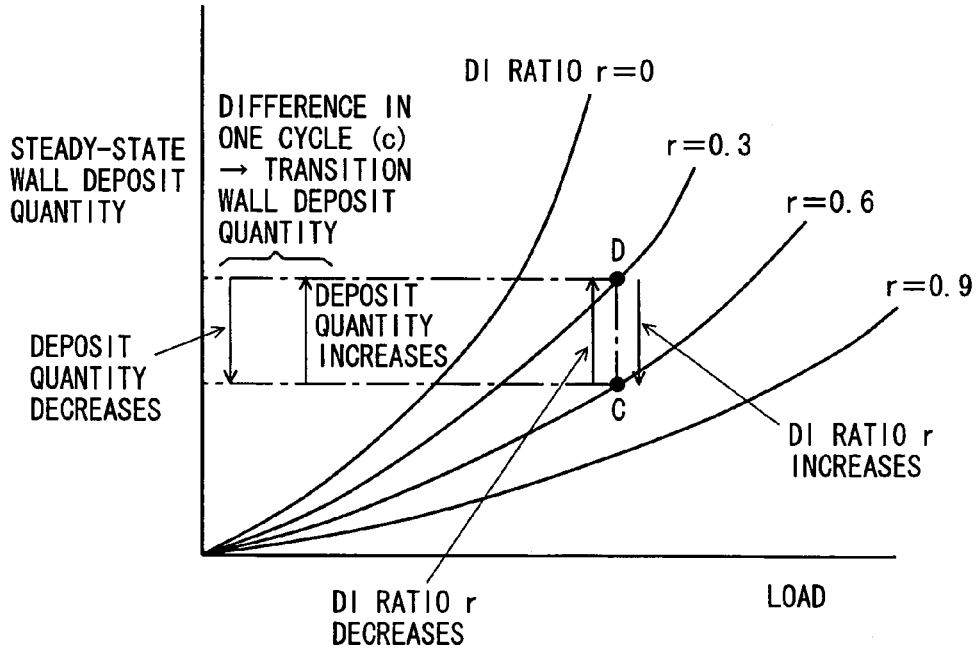
Figure 9:
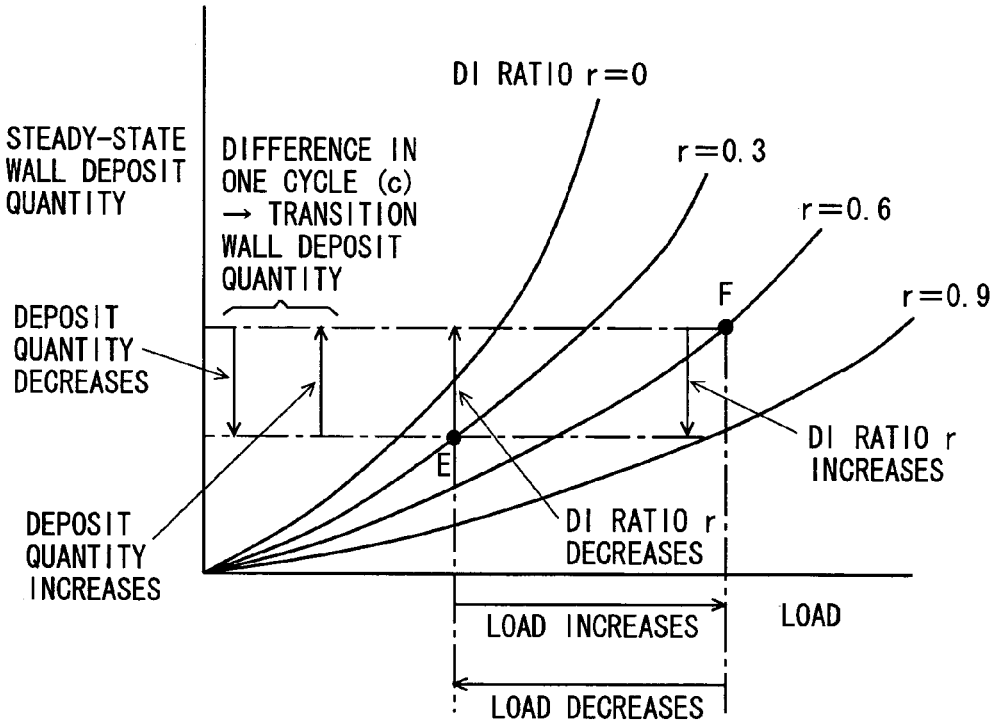

An operation of engine 10 controlled by engine ECU 300 implementing the control apparatus for an internal combustion engine of the present embodiment based on the above-described structure and flowchart will now be described. The following description encompasses all of the following three manners: when DI ratio r remains the same while the load to engine 10 increases and decreases (for example, when the load changes in the range where DI ratio r is the same) as shown in FIG. 7; when the load to engine 10 remains the same while DI ratio r increases and decreases (for example, when the engine speed changes while the load is the same) as shown in FIG. 8; and when the load to engine 10 increases and decreases while DI ratio r increases and decreases, as shown in FIG. 9.

At predetermined time intervals, a wall deposit quantity as to a case where DI ratio r after warm-up of engine 10=0 (fuel injection of intake manifold injector 120 alone) is calculated as steady-state wall deposit quantity (a), from characteristic curve (a) shown in FIG. 3 (S100). Reflecting DI ratio r on this steady-state wall deposit quantity (a), shared-injection steady-state wall deposit quantity (b) is calculated (S110).

Difference (c) of steady-state wall deposit quantity (b) in one cycle (720° CA) of engine 10 is calculated (S120), which is then corrected considering the temperature or engine speed of engine 10 to calculate transition correction quantity (d) (S130). This correction quantity (d) is a correction quantity by a wall deposited fuel at transition (wall deposit correction quantity: fmw). Based on the wave form representing temporal transition as shown in FIGS. 4 and 5, the temporal variation of the correction quantity is calculated (S140). With higher priority on a correction on intake manifold injector 120 that is a factor of the wall-deposited fuel, wall deposit correction quantity fmw is allotted to be shared by in-cylinder injector 110 and intake manifold injector 120.

As a result of such allotment when wall deposit correction quantity fmw takes on a value of minus and a fuel injection quantity must be decreased, if the fuel injection quantity must be decreased to a range without the linearity of Q-tau characteristics of intake manifold injector 120, the fuel injection quantity of intake manifold injector 120 is set to 0 or to the minimum injection quantity where the linearity is ensured, and the reminder of the decrease is achieved by in-cylinder injector 110.

On the other hand, when wall deposit correction quantity fmw takes on a value of plus and a fuel injection quantity must be increased, if the fuel injection quantity must be increased exceeding the maximum injection quantity of intake manifold injector 120, the fuel injection quantity of intake manifold injector 120 is set to the maximum injection quantity, and the reminder of the increase is achieved by in-cylinder injector 110.

Referring to the transition from A to B in FIG. 7, DI ratio r is constant and the load increases, and the wall deposit quantity of the intake manifold increases. Therefore, wall deposit correction quantity fmw takes on a value of plus. With higher priority on increasing the fuel injection quantity of intake manifold injector 120, if the maximum injection quantity of intake manifold injector 120 is to be exceeded, the fuel injection quantity of in-cylinder injector 110 is increased as well.

Referring to the transition from B to A in FIG. 7, DI ratio r is constant and the load decreases, and the wall deposit quantity of the intake manifold decreases. Therefore, wall deposit correction quantity fmw takes on a value of minus. With higher priority on decreasing the fuel injection quantity of intake manifold injector 120, if it must be decreased below the minimum injection quantity of intake manifold injector 120 in the range with linearity, the fuel injection quantity of in-cylinder injector 110 is decreased as well.

Referring to the transition from C to D in FIG. 8, the load to engine 10 is constant and DI ratio decreases (that is, an injection ratio of intake manifold injector 120 increases), and the wall deposit quantity of the intake manifold increases. Therefore, wall deposit correction quantity fmw takes on a value of plus. With higher priority on increasing the fuel injection quantity of intake manifold injector 120, if the maximum injection quantity of intake manifold injector 120 is to be exceeded, the fuel injection quantity of in-cylinder injector 110 is increased as well.

Referring to the transition from D to C in FIG. 8, the load to engine 10 is constant and DI ratio increases (that is, an injection ratio of intake manifold injector 120 decreases), and the wall deposit quantity of the intake manifold decreases. Therefore, wall deposit correction quantity fmw takes on a value of minus. With higher priority on decreasing the fuel injection quantity of intake manifold injector 120, if it must be decreased below the minimum injection quantity of intake manifold injector 120 in the range with linearity, the fuel injection quantity of in-cylinder injector 110 is decreased as well.

Referring to the transition from E to F in FIG. 9, the load to engine 10 increases and DI ratio decreases (that is, an injection ratio of intake manifold injector 120 increases), and the wall deposit quantity of the intake manifold increases. Therefore, wall deposit correction quantity fmw takes on a value of plus. With higher priority on increasing the fuel injection quantity of intake manifold injector 120, if the maximum injection quantity of intake manifold injector 120 is to be exceeded, the fuel injection quantity of in-cylinder injector 110 is increased as well.

Referring to the transition from F to E in FIG. 9, the load to engine 10 decreases and DI ratio increases (that is, an injection ratio of intake manifold injector 120 decreases), and the wall deposit quantity of the intake manifold decreases. Therefore, wall deposit correction quantity fmw takes on a value of minus. With higher priority on decreasing the fuel injection quantity of intake manifold injector 120, and if it must be decreased below the minimum injection quantity of intake manifold injector 120 in the range with linearity, the fuel injection quantity of in-cylinder injector 110 is decreased as well.

As above, when the in-cylinder injector and intake manifold injector bear shares, respectively, of injecting the fuel, when DI ratio r increases stepwise ($r<1$) or when the load decreases, the fuel injection quantity of the intake manifold injector decreases stepwise. Here, the fuel deposited on the intake port is taken into the combustion chamber to make the air-fuel ratio rich. Accordingly, a correction is made with higher priority on the intake manifold injector. If a fuel quantity in an attempt to make a correction to decrease the fuel injection quantity of the intake manifold injector becomes smaller than the minimum injection quantity in the range with linearity, a correction to the wall-deposited fuel by decreasing the fuel injection quantity of the intake manifold injector is no longer possible. In this state, as the air-fuel ratio is still rich, a correction to the wall-deposited fuel is made using the in-cylinder injector. The fuel injection quantity of the in-cylinder injector is determined by subtracting a fuel injection quantity that could not be covered the intake manifold injector.

Additionally, when DI ratio r decreases stepwise ($0<r$) or when the load increases, the fuel injection quantity of the intake manifold injector increases stepwise. Here, the fuel taken into the combustion chamber decreases until the fuel of a prescribed quantity deposits on the intake port to make the air-fuel ratio lean. Accordingly, a correction is made with higher priority on the intake manifold injector. If the fuel quantity in an attempt to make a correction to increase the fuel injection quantity of the intake manifold injector becomes greater than the maximum injection quantity, a correction to the wall-deposited fuel by increasing the fuel injection quantity of the intake manifold injector is no longer possible. In this state, as the air-fuel ratio is still lean, a correction to the wall-deposited fuel is made using the in-cylinder injector. The fuel injection quantity of the in-cylinder injector is determined by adding a fuel injection quantity that could not be covered by the intake manifold injector.

Engine (1) to Which Present Control Apparatus is Suitably Applied

An engine (1) to which the control apparatus of the present embodiment is suitably applied will now be described.

Figure 10:
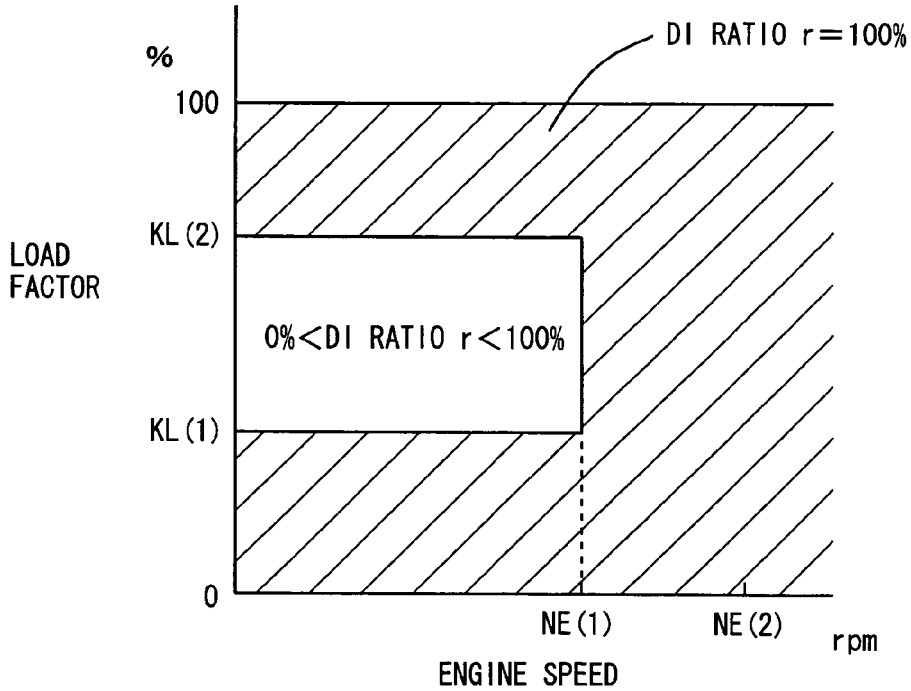
FIGS. 10 and 12 each show a DI ratio map for a warm state of an engine to which the control apparatus according to the present embodiment of the present invention is suitably applied.
Figure 11:
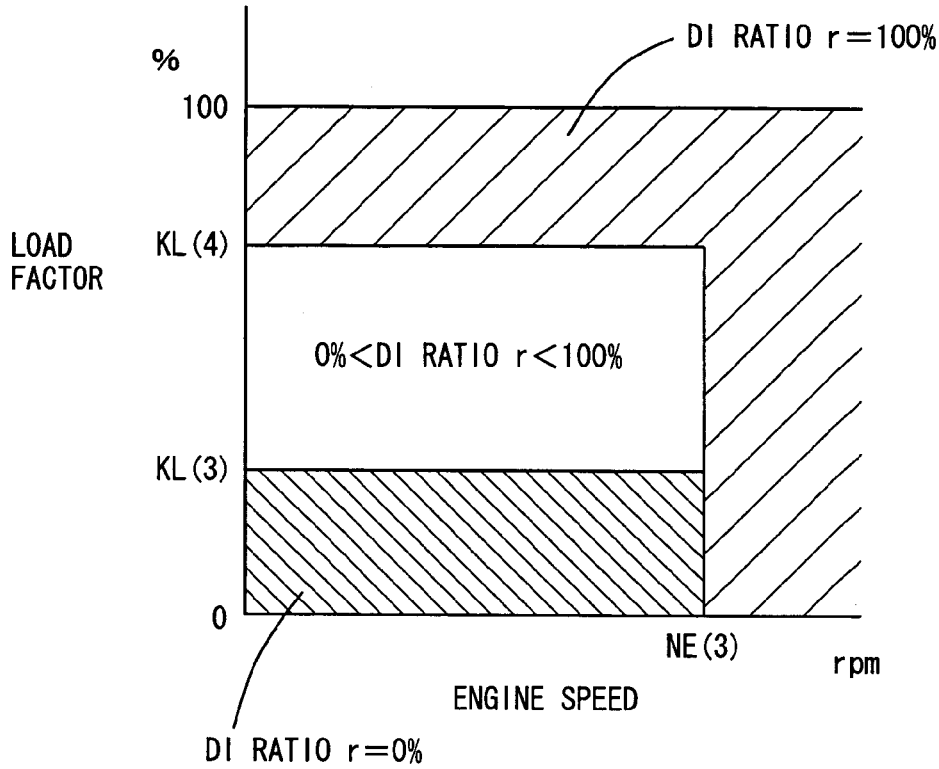
FIGS. 11 and 13 each show a DI ratio map for a cold state of an engine to which the control apparatus according to the embodiment of the present invention is suitably applied.

Referring to FIGS. 10 and 11, maps each indicating a fuel injection ratio between in-cylinder injector 110 and intake manifold injector 120, identified as information associated with an operation state of engine 10, will now be described. Herein, the fuel injection ratio between the two injectors is also expressed as a ratio of the quantity of the fuel injected from in-cylinder injector 110 to the total quantity of the fuel injected, which is referred to as the "fuel injection ratio of in-cylinder injector 110", or a "DI (Direct Injection) ratio (r)". The maps are stored in ROM 320 of engine ECU 300. FIG. 10 is the map for a warm state of engine 10, and FIG. 11 is the map for a cold state of engine 10.

In the maps illustrated in FIGS. 10 and 11, with the horizontal axis representing an engine speed of engine 10 and the vertical axis representing a load factor, the fuel injection ratio of in-cylinder injector 110, or the DI ratio r, is expressed in percentage.

As shown in FIGS. 10 and 11, the DI ratio r is set for each operation range that is determined by the engine speed and the load factor of engine 10. "DI RATIO r=100%" represents the range where fuel injection is carried out using only in-cylinder injector 110, and "DI RATIO r=0%" represents the range where fuel injection is carried out using only intake manifold injector 120. "DI RATIO r≠0%", "DI RATIO r≠100%" and "0%<DI RATIO r<100%" each represent the range where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of the engine (other than the abnormal operation state such as a catalyst warm-up state during idling).

Further, as shown in FIGS. 10 and 11, the fuel injection ratio between in-cylinder injector 110 and intake manifold injector 120, or, the DI ratio r, is defined individually in the map for the warm state and in the map for the cold state of the engine. The maps are configured to indicate different control ranges of in-cylinder injector 110 and intake manifold injector 120 as the temperature of engine 10 changes. When the temperature of engine 10 detected is equal to or higher than a predetermined temperature threshold value, the map for the warm state shown in FIG. 10 is selected; otherwise, the map for the cold state shown in FIG. 11 is selected. One or both of in-cylinder injector 110 and intake manifold injector 120 are controlled based on the selected map and according to the engine speed and the load factor of engine 10.

The engine speed and the load factor of engine 10 set in FIGS. 10 and 11 will now be described. In FIG. 10, NE(1) is set to 2500 rpm to 2700 rpm, KL(1) is set to 30% to 50%, and KL(2) is set to 60% to 90%. In FIG. 11, NE(3) is set to 2900 rpm to 3100 rpm. That is, NE(1)<NE(3). NE(2) in FIG. 10 as well as KL(3) and KL(4) in FIG. 11 are also set as appropriate.

When comparing FIG. 10 and FIG. 11, NE(3) of the map for the cold state shown in FIG. 11 is greater than NE(1) of the map for the warm state shown in FIG. 10. This shows that, as the temperature of engine 10 is lower, the control range of intake manifold injector 120 is expanded to include the range of higher engine speed. That is, in the case where engine 10 is cold, deposits are unlikely to accumulate in the injection hole of in-cylinder injector 110 (even if the fuel is not injected from in-cylinder injector 110). Thus, the range where the fuel injection is to be carried out using intake manifold injector 120 can be expanded, to thereby improve homogeneity.

When comparing FIG. 10 and FIG. 11, "DI RATIO r=100%" in the range where the engine speed of engine 10 is NE(1) or higher in the map for the warm state, and in the range where the engine speed is NE(3) or higher in the map for the cold state. In terms of load factor, "DI RATIO r=100%" in the range where the load factor is KL(2) or greater in the map for the warm state, and in the range where the load factor is KL(4) or greater in the map for the cold state. This means that in-cylinder injector 110 solely is used in the range of a predetermined high engine speed, and in the range of a predetermined high engine load. That is, in the high speed range or the high load range, even if fuel injection is carried out using only in-cylinder injector 110, the engine speed and the load of engine 10 are high, ensuring a sufficient intake air quantity, so that it is readily possible to obtain a homogeneous air-fuel mixture even using only in-cylinder injector 110. In this manner, the fuel injected from in-cylinder injector 110 is atomized within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 10, fuel injection is also carried out using only in-cylinder injector 110 when the load factor is KL(1) or less. This shows that in-cylinder injector 110 alone is used in a predetermined low load range when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 10 may be prevented while ensuring the minimum fuel injection quantity thereof. Thus, in-cylinder injector 110 alone is used in the relevant range.

When comparing FIG. 10 and FIG. 11, there is a range of "DI RATIO r=0%" only in the map for the cold state in FIG. 11. This shows that fuel injection is carried out using only intake manifold injector 120 in a predetermined low load range (KL(3) or less) when the temperature of engine 10 is low. When engine 10 is cold and low in load and the intake air quantity is small, atomization of the fuel is unlikely to occur. In such a range, it is difficult to ensure favorable combustion with the fuel injection from in-cylinder injector 110. Further, particularly in the low-load and low-speed range, high output using in-cylinder injector 110 is unnecessary. Accordingly, fuel injection is carried out using only intake manifold injector 120, rather than in-cylinder injector 110, in the relevant range.

Further, in an operation other than the normal operation, or, in the catalyst warm-up state during idling of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Engine (2) to Which Present Control Apparatus is Suitably Applied

Hereinafter, an engine (2) to which the control apparatus of the present embodiment is suitably applied will be described. In the following description of the engine (2), the configurations similar to those of the engine (1) will not be repeated.

Figure 12:
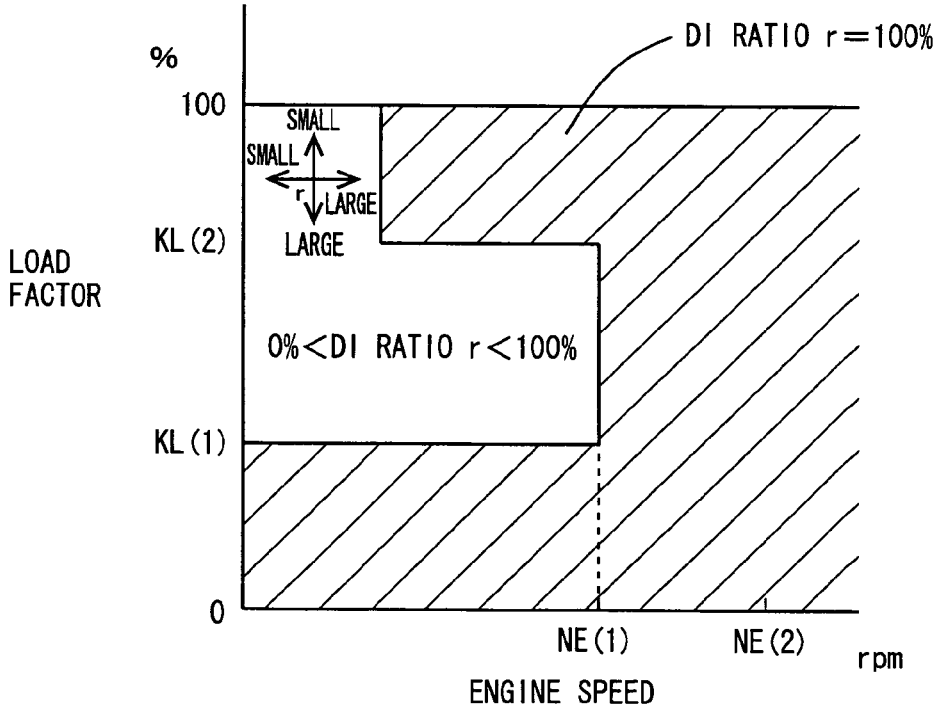
Figure 13:
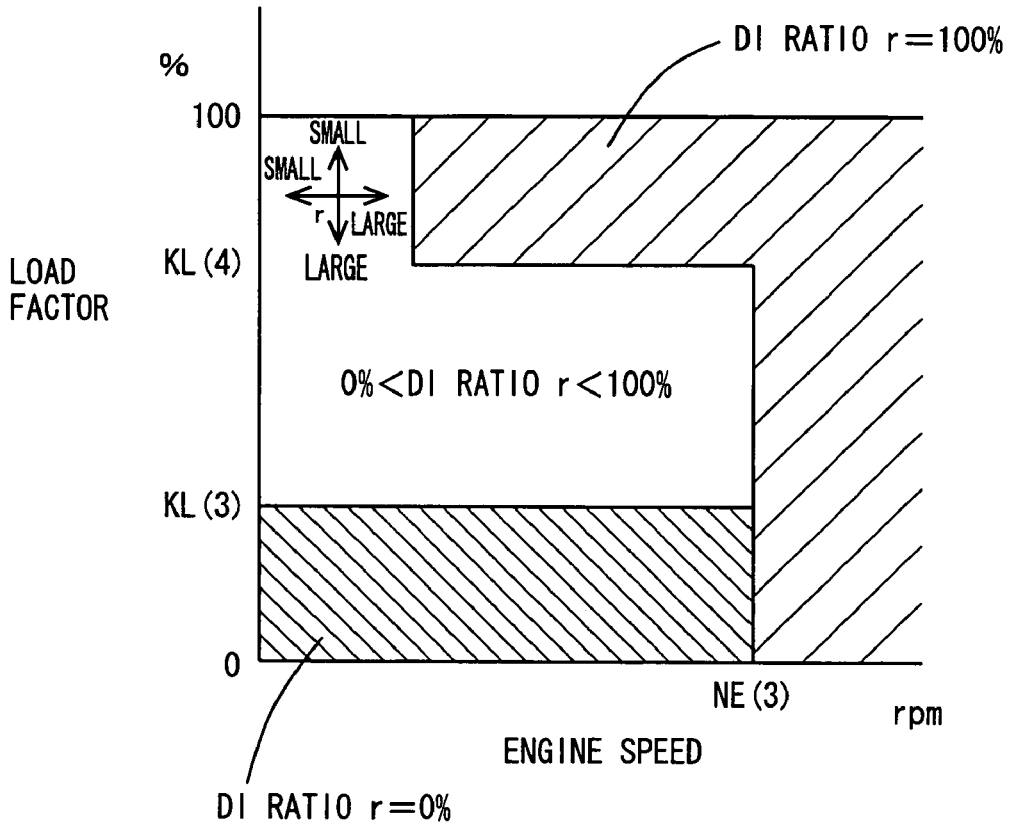

Referring to FIGS. 12 and 13, maps each indicating the fuel injection ratio between in-cylinder injector 110 and intake manifold injector 120, identified as information associated with the operation state of engine 10, will be described. The maps are stored in ROM 320 of engine ECU 300. FIG. 12 is the map for the warm state of engine 10, and FIG. 13 is the map for the cold state of engine 10.

FIGS. 12 and 13 differ from FIGS. 10 and 11 in the following points. "DI RATIO r=100%" holds in the range where the engine speed of the engine is equal to or higher than NE(1) in the map for the warm state, and in the range where the engine speed is NE(3) or higher in the map for the cold state. Further, except for the low-speed range, "DI RATIO r=100%" holds in the range where the load factor is KL(2) or greater in the map for the warm state, and in the range where the load factor is KL(4) or greater in the map for the cold state. This means that fuel injection is carried out using only in-cylinder injector 110 in the range where the engine speed is at a predetermined high level, and that fuel injection is often carried out using only in-cylinder injector 110 in the range where the engine load is at a predetermined high level. However, in the low-speed and high-load range, mixing of an air-fuel mixture formed by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed increases where such a problem is unlikely to occur, whereas the fuel injection ratio of in-cylinder injector 110 is decreased as the engine load increases where such a problem is likely to occur. These changes in the fuel injection ratio of in-cylinder injector 110, or, the DI ratio r, are shown by crisscross arrows in FIGS. 12 and 13. In this manner, variation in output torque of the engine attributable to the unstable combustion can be suppressed. It is noted that these measures are approximately equivalent to the measures to decrease the fuel injection ratio of in-cylinder injector 110 as the state of the engine moves toward the predetermined low speed range, or to increase the fuel injection ratio of in-cylinder injector 110 as the engine state moves toward the predetermined low load range. Further, except for the relevant range (indicated by the crisscross arrows in FIGS. 12 and 13), in the range where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 is atomized within the combustion chamber involving latent heat of vaporization (by absorbing heat from the combustion chamber). Accordingly, the temperature of the air-fuel mixture is decreased at the compression side, and thus, the antiknock performance improves. Further, with the temperature of the combustion chamber decreased, intake efficiency improves, leading to high power output.

In engine 10 explained in conjunction with FIGS. 10–13, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in conjunction with FIGS. 10–13, the fuel injection timing of in-cylinder injector 110 is set in the intake stroke in a basic range corresponding to the almost entire range (here, the basic range refers to the range other than the range where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having a first fuel injection mechanism injecting fuel into a cylinder and a second fuel injection mechanism injecting the fuel into an intake manifold, comprising:

a controller controlling said first and second fuel injection mechanisms to bear shares, respectively, of injecting the fuel based on a condition required for said internal combustion engine; and an estimator estimating wall-deposited fuel of said intake manifold when a fuel injection ratio varies from a state where one of said first and second fuel injection mechanisms does not stop fuel injection, wherein said estimator estimates said wall-deposited fuel of said intake manifold based on at least one of a load of said internal combustion engine and said fuel injection ratio, wherein said first fuel injection mechanism is an in-cylinder injector and said second fuel injection mechanism is an intake manifold injector.

2. The control apparatus for an internal combustion engine according to claim 1, wherein said estimator calculates a wall deposit quantity solely by said second fuel injection mechanism in a steady state, in accordance with said load of said internal combustion engine, said estimator modifies calculated said wall-deposit quantity, in accordance with said fuel injection ratio, and said estimator estimates said wall-deposited fuel of said intake manifold based on a difference of modified said wall deposit quantity in predetermined time intervals.

3. The control apparatus for an internal combustion engine according to claim 1, wherein said controller controls said first and second fuel injection mechanisms to bear shares, respectively, of correcting estimated said wall-deposited fuel for a range where said first and second fuel injection mechanisms bear shares, respectively, of a fuel injection quantity.

4. The control apparatus for an internal combustion engine according to claim 3, wherein said controller controls said first and second fuel injection mechanisms to correct said estimated wall-deposited fuel based on a temporal variation of a correction quantity being set corresponding to a load variation.

5. The control apparatus for an internal combustion engine according to claim 3, wherein said controller corrects said wall-deposited fuel placing higher priority on said second fuel injection mechanism.

6. The control apparatus for an internal combustion engine according to claim 3, wherein said controller controls said first and second fuel injection mechanisms so that, when a fuel quantity decreased by said correction becomes smaller than a minimum fuel quantity of said second fuel injection mechanism, a fuel injection quantity of said second fuel injection mechanism is set to 0 or to said minimum fuel quantity and a remainder of the correction is covered by a fuel injection quantity of said first fuel injection mechanism.

7. The control apparatus for an internal combustion engine according to claim 3, wherein said controller controls said first and second fuel injection mechanisms so that, when a fuel quantity increased by said correction becomes greater than a maximum fuel quantity of said second fuel injection mechanism, a fuel injection quantity of said second fuel injection mechanism is set to said maximum fuel quantity and a remainder of the correction is covered by a fuel injection quantity of said first fuel injection mechanism.

8. A control apparatus for an internal combustion engine having first fuel injection means for injecting fuel into a cylinder and second fuel injection means for injecting the fuel into an intake manifold, comprising:

controlling means for controlling said first and second fuel injection means to bear shares, respectively, of injecting the fuel based on a condition required for said internal combustion engine; and estimating means for estimating wall-deposited fuel of said intake manifold when a fuel injection ratio varies from a state where one of said first and second fuel injection means does not stop fuel injection, wherein said estimating means includes means for estimating said wall-deposited fuel of said intake manifold based on at least one of a load of said internal combustion engine and said fuel injection ratio, wherein said first fuel injection means is an in-cylinder injector and said second fuel injection means is an intake manifold injector.

9. The control apparatus for an internal combustion engine according to claim 8, said estimating means including:

means for calculating a wall deposit quantity solely by said second fuel injection means in a steady state, in accordance with said load of said internal combustion engine;

means for modifying calculated said wall-deposit quantity, in accordance with said fuel injection ratio; and means for estimating said wall-deposited fuel of said intake manifold based on a difference of modified said wall deposit quantity in predetermined time intervals.

10. The control apparatus for an internal combustion engine according to claim 8, wherein said controlling means includes means for controlling said first and second fuel injection means to bear shares, respectively, of correcting estimated said wall-deposited fuel for a range where said first and second fuel injection means bear shares, respectively, of a fuel injection quantity.

11. The control apparatus for an internal combustion engine according to claim 10, wherein said controlling means includes means for controlling said first and second fuel injection means to correct said estimated wall-deposited fuel based on a temporal variation of a correction quantity being set corresponding to a load variation.

12. The control apparatus for an internal combustion engine according to claim 10, wherein said controlling means includes means for correcting said wall-deposited fuel placing higher priority on said second fuel injection means.

13. The control apparatus for an internal combustion engine according to claim 10, wherein said controlling means includes means for controlling said first and second fuel injection means so that, when a fuel quantity decreased by said correction becomes smaller than a minimum fuel quantity of said second fuel injection means, a fuel injection quantity of said second fuel injection means is set to 0 or to said minimum fuel quantity and a remainder of the correction is covered by a fuel injection quantity of said first fuel injection means.

14. The control apparatus for an internal combustion engine according to claim 10, wherein said controlling means includes means for controlling said first and second fuel injection means so that, when a fuel quantity increased by said correction becomes greater than a maximum fuel quantity of said second fuel injection means, a fuel injection quantity of said second fuel injection means is set to said maximum fuel quantity and a remainder of the correction is covered by a fuel injection quantity of said first fuel injection means.

* * * * *